United States Patent [19]

Camilleri

[11] Patent Number: 4,825,504

[45] Date of Patent: May 2, 1989

[54] END CAP

[75] Inventor: Charles F. Camilleri, St. Louis, Mo.

[73] Assignee: Lee-Rowan Company, St. Louis, Mo.

[21] Appl. No.: 236,046

[22] Filed: Aug. 24, 1988

[51] Int. Cl.[4] ..... F16L 57/00

[52] U.S. Cl. ..... 16/108; 248/188.9; 248/345.1

[58] Field of Search ..... 16/108, 109; 248/188.9, 248/345.1; 211/149, 150, 153, 181, 182, 183; 108/152; 135/77, 36 RT; D6/462, 463, 464, 465, 491

[56] References Cited

U.S. PATENT DOCUMENTS

| | | | |
|---|---|---|---|
| 197,417 | 11/1877 | Shoeninger | 16/108 |
| 1,556,966 | 10/1925 | Selig | 135/77 X |
| 4,347,498 | 2/1983 | Yellin | 211/182 |

*Primary Examiner*—Fred A. Silverberg

*Attorney, Agent, or Firm*—Rogers, Howell, Moore & Haferkamp

[57] ABSTRACT

An end cap for selective installation on rod ends of different diameters. The end cap is a cup-like member having an annular side wall extending between a closed end and an open end. Adjacent the open end, the annular side wall has a substantially cylindrical section which leads to a tapered section of gradually reducing diameter toward the closed end.

2 Claims, 1 Drawing Sheet

END CAP

BACKGROUND AND SUMMARY

This invention relates to an end cap for installation on rods of different diameters, such as in shelving systems having different sizes of shelves.

Metal shelving is made up of rods welded together. End caps are used to cover the ends of the rods. A shelving system includes different shelves of different sizes and the rods used to form the different shelves are likewise of different diameters. It has been customary to cover these rod ends with end caps. These end caps are plastic caps, each having a cylindrical side wall and a closed end with the other end open. The inside diameter of side wall is gauged to the size of a rod, and to accommodate the different sizes of rods different sizes of end caps have been required. As a result, a supplier of shelving systems must keep an inventory of different sizes of end caps corresponding to the different shelve sizes.

The present invention avoids the defects of the prior art by providing an end cap design that accommodates rods of different diameters. As a result, only one size and configuration of end cap need be retained in inventory. In addition, the design of this end cap makes its installation easier than end caps of the prior art.

In summary, this invention comprises an end cap that has an annular side wall extending between a closed end and an open end. The end cap is molded of a pliable resilient plastic. The annular side wall has a tapered section and a substantially cylindrical section. The cylindrical section is adjacent the open end and the tapered section extends from the cylindrical section to the closed end. The tapered section gradually decreases in diameter toward the closed end.

The end cap accommodates rods of different diameters. Because of the substantially cylindrical section, introduction of even the largest diameter rods is relatively easy because the resistance of the tapered section is not met until the cap is fully started onto the rod. Because the side wall of the end cap has different diameters, it can accommodate rods of different diameters and the end cap will remain in place on all of the different rods.

DETAILED DESCRIPTION OF THE DRAWINGS

DETAILED DESCRIPTION OF PREFERRED EMBODIMENT

Figure 1:
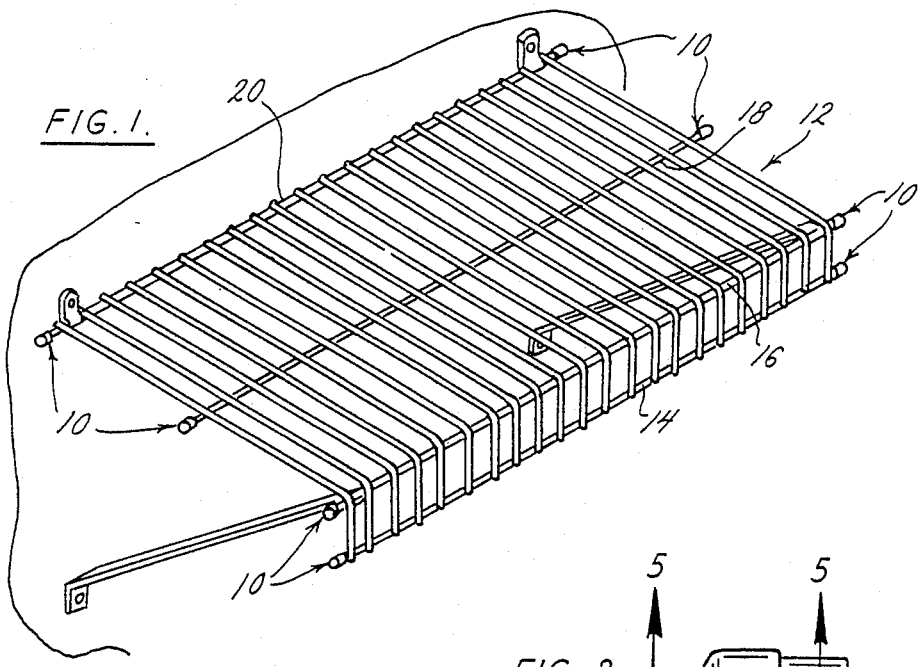
FIG. 1 is a perspective view of a typical shelf of one size that is a component of a shelving system that has similar shelves of other sizes and illustrating the installation of rod end caps of this invention.

Although it could have other applications, this end cap 10 is particularly adapted to be installed on the exposed ends of various rods on a shelf 12. The shelf has rods 14, 16, 18 and 20 that have exposed ends that are to be covered by the end cap 10. The shelf 12 is one component of a shelving system and other shelves (not shown) are other components. The rods 14–20 of one shelf 12 are of a diameter different from the diameter of rods of another shelf, but the end cap 10 will fit and remain on the exposed ends of all the rods of the different diameters.

The end cap 10 is a cup-like member of pliable, resilient vinyl having a cavity 22 defined by a closed end wall 24 that has an inner surface 26. An annular side wall 28 extends from the end wall 24 and has an inner surface 30. The end 32 opposite the end 24 is open for introduction of the end of a rod or wire.

Figure 3:
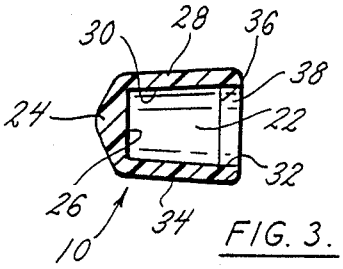
FIG. 3 is an enlarged view in medial section on a plane through the longitudinal axis of the end cap.

As particularly illustrated in FIG. 3, the annular side wall 28 has a section 34 that is tapered from a larger diameter near the open end 32 toward a smaller diameter at the closed end 24. Preferably, the tapered section 34, for example, starts at a diameter of about 0.207 inch at the end wall surface 26 and extends axially a distance of about $\frac{5}{8}$ inch to an intersection circle 36 having a diameter of about 0.240 inch. At the circle 36, the tapered section 34 meets a cylindrical section 38 that is of substantially constant diameter of about 0.240 inch and extends a distance of about 1/16 inch. While these dimensions are considered suitable for use of the end caps 10 with commercially available shelving systems, it will be recognized that the dimensions can be changed to accommodate other sizes of rod ends.

Operation and Use

Figure 2:
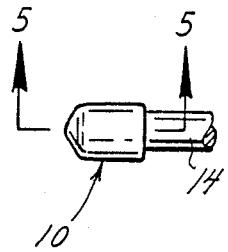
FIG. 2 is an enlarged side elevation view of an end cap as installed on the end of a shelving rod.
Figure 5:
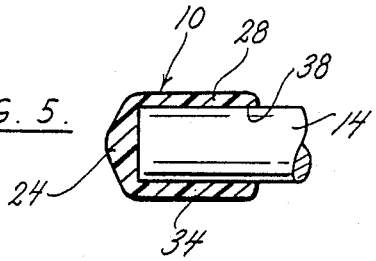
FIG. 5 is an enlarged view in section taken along the plane of the line 5—5 of FIG. 2 showing the end cap installed on a relatively large diameter rod end.

FIGS. 2 and 5 illustrate the installation of this end cap 10 on a rod 14 of relatively large diameter that somewhat stretches even the largest diameter section 38. It is with this larger size wire 14 that the section 38 is particularly advantageous because it allows the cap 10 to be started onto the rod end before the rod encounters the section 34 that progressively resists insertion of the rod. By the time the rod end reaches the section 34, it will have been fully introduced into the end cap 10. The end cap 10 is then pushed further until the end of the rod 14 bottoms against the surface 26 f the closed end 24.

Figure 6:
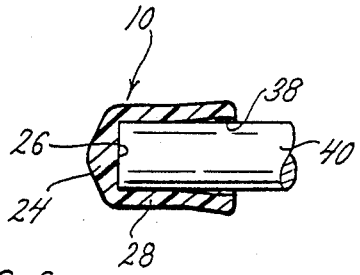
FIG. 6 is a view in section similar to that of FIG. 5 but showing the end cap installed on a relatively small diameter rod end.
Figure 4:
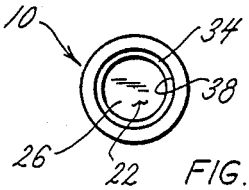
FIG. 4 is an end view of the open end of the end cap.

For a wire 40 of smaller diameter, as illustrated in FIG. 6, the larger diameter section 38 loosely surrounds the rod. However, as the rod is pushed to the tapered section 34, it contacts the inner wall 30 and, as the cap 10 is pushed further, a portion of the tapered section 34 contacts the rod end. When the end cap 10 has been pushed to the point where the end surface 26 contacts the end of the rod 40, a portion of the side wall 30 will grip the rod, and the end cap 10 will remain firmly in place.

As can now be appreciated, this invention provides a very simple and inexpensive end cap 10 that is easily installed even though the end cap is adapted to be installed on different diameters of rods. Only one inventory of end caps need be kept even though a shelving system may include a shelf 12 having rod of a relatively large diameter and other shelves (not shown) having rods of different but smaller diameters. The diameters of the rods may range in increments, for example, from about 0.250 inch to about 0.219 inch.

There are various changes and modifications which may be made to the invention as would be apparent to those skilled in the art. However, these changes or modifications are included in the teaching of the disclosure, and it is intended that the invention be limited only by the scope of the claims appended hereto.

What I claim is:

1. A solid one-piece end cap for selective installation on rod ends of different diameters comprising: a cup-like member of resilient plastic having an internal and an external side wall, a relatively large open end and a relatively small closed end, said side walls being substantially frusto-conical in shape and converging from the open end to the closed end, said side walls being deformable and resilient to stretch over and cling to an end of a rod, said side walls continuously converging from a point substantially at the open end to the closed end, said side walls being substantially smooth throughout their length.

2. The end cap of claim 1 wherein a section of the side walls adjacent the open end being substantially cylindrical.

* * * * *